US012352014B2

(12) United States Patent
Patel et al.

(10) Patent No.: US 12,352,014 B2
(45) Date of Patent: Jul. 8, 2025

(54) ENHANCED ELECTRICAL CONTROL OF A HYDRAULIC SYSTEM

(71) Applicant: Caterpillar Inc., Peoria, IL (US)

(72) Inventors: Darshan C. Patel, Des Plaines, IL (US); Wesley Thomas Payne, Plainfield, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/527,388

(22) Filed: Dec. 4, 2023

(65) Prior Publication Data

US 2025/0179774 A1 Jun. 5, 2025

(51) Int. Cl.
*E02F 9/22* (2006.01)

(52) U.S. Cl.
CPC ..... *E02F 9/2296* (2013.01); *E02F 9/2228* (2013.01)

(58) Field of Classification Search
CPC ..... E02F 9/2228; F15B 11/165; F15B 2211/50536
See application file for complete search history.

(56) References Cited

U.S. PATENT DOCUMENTS

| | | | | |
|---|---|---|---|---|
| 4,124,226 | A | 11/1978 | Phillips | |
| 4,470,259 | A | 9/1984 | Miller et al. | |
| 5,571,226 | A * | 11/1996 | Kobayashi | E02F 9/226 37/348 |
| 9,725,884 | B2 | 8/2017 | Hashimoto | |
| 10,590,623 | B2 | 3/2020 | Karasawa et al. | |
| 10,989,231 | B2 | 4/2021 | Wechsel et al. | |
| 11,111,931 | B2 | 9/2021 | Muraoka et al. | |
| 2017/0198831 | A1 * | 7/2017 | Beschorner | E02F 9/2203 |
| 2021/0301500 | A1 | 9/2021 | Metzger et al. | |

FOREIGN PATENT DOCUMENTS

| | | | |
|---|---|---|---|
| JP | 4807888 | B2 | 11/2011 |

* cited by examiner

*Primary Examiner* — Abiy Teka
(74) *Attorney, Agent, or Firm* — Xsensus, LLP

(57) ABSTRACT

In some implementations, a hydraulic system may include a tank, a hydraulic pump, an actuator, and an unloading valve positioned between the pump and the tank. The hydraulic system may receive one or more inputs associated with the hydraulic system. The hydraulic system may determine, based on the one or more inputs, one or more desired system pressures associated with the hydraulic system. The hydraulic system may proportionally regulate an opening of the unloading valve to operate the hydraulic system at the one or more desired system pressures.

20 Claims, 4 Drawing Sheets

ENHANCED ELECTRICAL CONTROL OF A HYDRAULIC SYSTEM

TECHNICAL FIELD

The present disclosure relates generally to a hydraulic system, and, for example, to enhanced electrical control of a hydraulic system.

BACKGROUND

A machine (e.g., a work machine and/or a construction machine) may be used to perform one or more worksite operations (e.g., one or more material transfer, digging, scraping, and/or dozing worksite operations). Typically, such a machine includes a hydraulic system that controls movement of the machine and/or a component of the machine (e.g., an implement). In some cases, the hydraulic system is a proportional flow control (PFC) hydraulic system, which proportionally controls a flow rate, directional control, and restrictions for hydraulic fluid within the hydraulic system.

Typically, a PFC hydraulic system uses a flow control valve having a fixed restriction to a tank (e.g., a low-pressure tank), such as a fixed restriction in a last spool section of the flow control valve, to facilitate hydraulic pump standby controls or to enable the controlled flow of hydraulic fluid to a tank (e.g., a fluid reservoir) of the hydraulic system at a specified pressure. This configuration allows the hydraulic system to transition between operation modes, directing excess hydraulic pump flow to the tank while maintaining precise pressure levels when standby controls are activated.

Additionally, the PFC hydraulic system typically uses a main relief valve, in combination with the fixed restriction, for power-generating functions, such as regeneration or thermal management functions (e.g., by creating a hydraulic system load through elevated hydraulic pump flow and pressure via the main relief valve and the fixed restriction). However, in some cases, there are some drawbacks associated with typical PFC hydraulic systems. As an example, when the PFC hydraulic system is not operating at full capacity (e.g., during partial implement commands where less flow is needed), the fixed restriction to tank still creates a constant flow resistance, which leads to hydraulic fluid losses to the tank resulting in decreased efficiency (e.g., associated with an increase in heat load and power consumption).

Furthermore, to enable low hydraulic pump loads, the PFC hydraulic system typically uses separate float unloading valve components to direct the hydraulic pump flow to the tank. As an example, during a cold engine start (e.g., when a demand of the hydraulic system is minimal), the separate float unloading valve components initiate a controlled flow diversion that effectively reroutes a portion of an output of the hydraulic pump flow to the tank. This redirection prevents the hydraulic pump from operating at elevated pressure capacity, thereby minimizing the load imposed on the engine during the cold engine start. However, this approach (e.g., using separate float unloading valve components) introduces heightened intricacy and expenses to the hydraulic circuit, while also introducing additional potential points of failure.

U.S. Pat. No. 9,725,884 ("the '884 patent") describes a hydraulic circuit of a construction machine. As described in the '884 patent, the hydraulic circuit includes center bypass passages, into which a pressurized oil discharged from a plurality of hydraulic pumps is supplied, a directional control valve group including a plurality of directional control valves that are arranged in tandem with the center bypass passages, a bleed-off valve arranged on a downstream side of each center bypass passage relative to the directional control valve group; and a merging circuit that merges the pressurized oil supplied into one center bypass passage of the plurality of center bypass passages and the pressurized oil in another center bypass passage of the plurality of center bypass passages.

As further described in the '884 patent, each directional control valve includes a first internal passage that flows the pressurized oil supplied into the directional control valve out into each center bypass passage and a second internal passage that supplies the pressurized oil supplied to the directional control valve to a hydraulic actuator of the construction machine. The center bypass passage and the first internal passage form a parallel passage where the first internal passage flows the pressurized oil discharged from the hydraulic pump out onto downstream sides of the center bypass passage relative to the directional control valve. The bleed-off valve performs a bleed-off control for the pressurized oil supplied through the parallel passage by changing an opening area of the bleed-off valve. The merging circuit includes a merging directional control valve that is arranged on an upstream side of the bleed-off valve and controls an inflow direction of the pressurized oil so that the pressurized oil in the one center bypass passage is merged into the pressurized oil in the another center bypass passage to cause the hydraulic actuator corresponding to the directional control valve to be preferentially operated by the pressurized oil in the one center bypass passage through the parallel passage arranged in the another center bypass passage.

SUMMARY

Some implementations described herein relate to a hydraulic system associated with enhanced electrical control. The hydraulic system may include a tank to store a supply of fluid; a pump to supply pressurized fluid; an actuator that is displaceable within a range from a minimum position to a maximum position; an unloading valve positioned between the pump and the tank, wherein the unloading valve includes an opening that is proportionally controllable; and a controller configured to: receive one or more inputs associated with the hydraulic system; determine, based on the one or more inputs, one or more desired system pressures of the hydraulic system; and control the opening of the unloading valve to operate the hydraulic system at the one or more desired system pressures.

Some implementations herein relate to a method for controlling a hydraulic system. The hydraulic system may include a controller, a tank, a pump, and an unloading valve positioned between the tank and the pump, the method comprising: receiving, by the controller, one or more inputs associated with the hydraulic system; determining, by the controller and based on the one or more inputs, one or more desired system pressures associated with the hydraulic system; and proportionally regulating, by the controller, an opening of the unloading valve to operate the hydraulic system at the one or more desired system pressures.

Some implementations herein relate to a machine having a hydraulic system associated with enhanced electrical control. The hydraulic system of the machine may include: a tank to store a supply of fluid; a pump to supply pressurized fluid; an actuator that is displaceable from a minimum position to a maximum position; an unloading valve, positioned between the pump and the tank, including an opening that is proportionally controllable; and a controller configured to: receive one or more inputs associated with at least one of the machine or the hydraulic system; determine, based on the one or more inputs, one or more desired system pressures associated with at least one of the machine or the hydraulic system; and control the opening of the unloading valve to operate the hydraulic system at the one or more desired system pressures.

DETAILED DESCRIPTION OF EXAMPLE EMBODIMENTS

The following detailed description of example implementations refers to the accompanying drawings. The same reference numbers in different drawings may identify the same or similar elements.

The present disclosure relates to a hydraulic system associated with enhanced electrical control (e.g., which enables reduced parasitic losses and increased efficiency). The hydraulic system may be used by a machine (e.g., a wheel loader, an excavator, a bulldozer, a backhoe loader, and/or a crane, among other example) to perform one or more operations (e.g., one or more loading operations, lifting, operations, hauling operations, and/or dumping operations, among other examples). As an example, the machine may use the hydraulic system to control one or more implements that are used to perform the one or more operations. The hydraulic system may include one or more hydraulic components (e.g., one or more cylinders, actuators, solenoids, and/or valves, among other examples) as described in more detail elsewhere herein.

Figure 1:
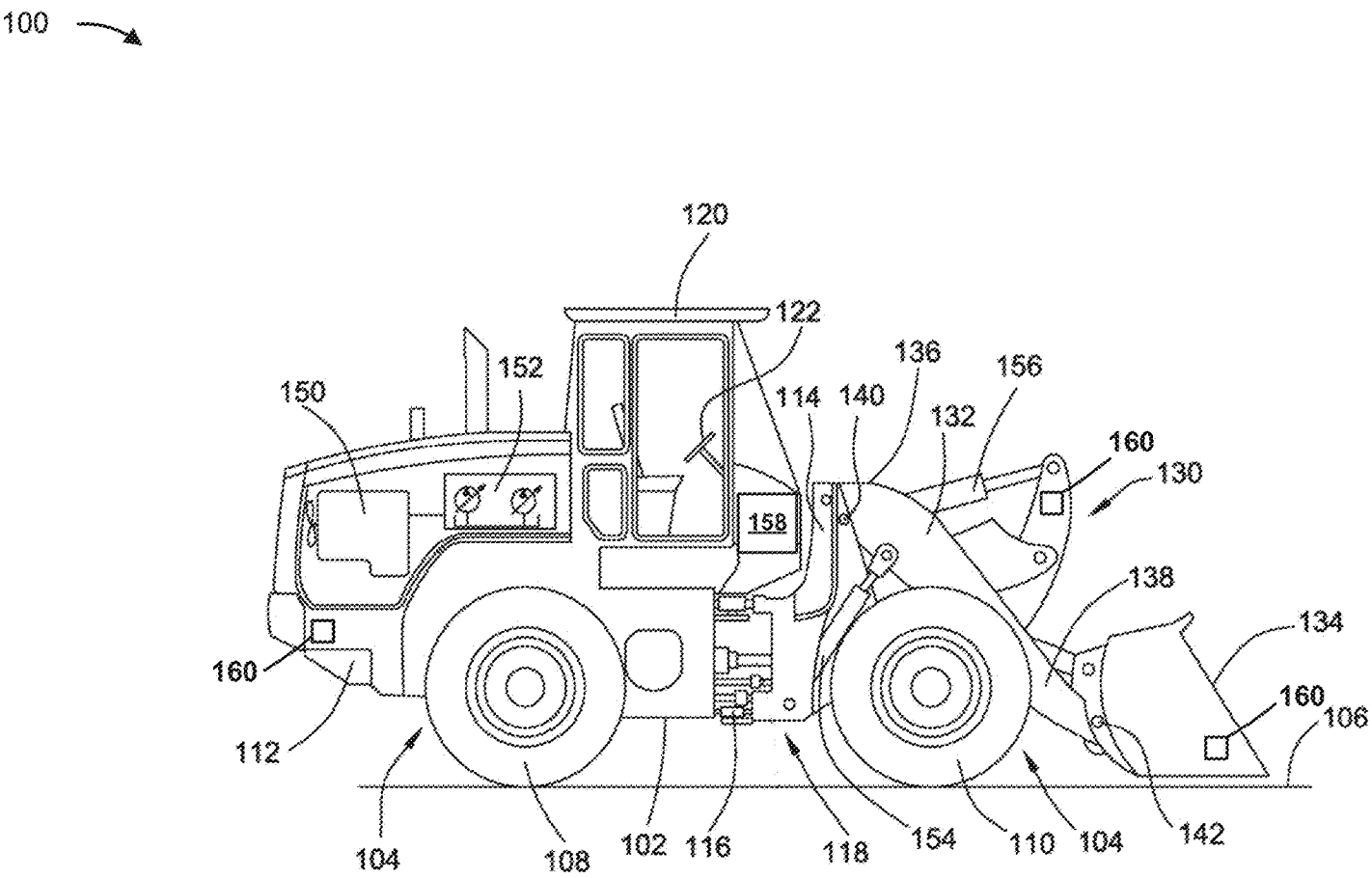
FIG. 1 is a diagram of an example machine described herein.

FIG. 1 is an example machine 100 described herein. As shown in FIG. 1, the machine 100 is embodied as a wheel loader. Although the machine 100 is embodied as a wheel loader, the machine 100 may be any suitable machine. As shown in FIG. 1, the machine 100 includes a frame 102 and one or more tractions devices 104 that enable the machine 100 to move over a ground surface 106 (e.g., a work surface) and/or under a ground surface (e.g., in association with an underground machine). The one or more tractions devices 104 include a set of rear wheels 108 (e.g., that may be power-driven via an engine and transmission of the machine 100) and a set of front wheels 110 (e.g., that may be primarily used for steering the machine 100).

As further shown in FIG. 1, the frame 102 includes a rear end 112 and a front end 114 that are operatively connected to one another via an articulation joint 116, which enables the rear end 112 and the front end 114 to pivot with respect to one another. The set of rear wheels 108 are disposed on the rear end 112 of the machine 100 and the set of front wheels 110 are disposed on the front end 114 of the machine 100 to form part of a hydraulic steering assembly 118 of the machine 100.

As further shown in FIG. 1, the machine 100 includes an operator station 120 that is supported by the frame 102. The operator station 120 includes an operator interface 122 (e.g., shown as a steering wheel in FIG. 1). Although the operator interface 122 is shown and described as being a steering wheel in connection with FIG. 1, the operator interface 122 may be any suitable operator interface (e.g., one or more joysticks, levers, knobs, pedals, and/or switches, among other examples). An operator may interact with the one or more operator interfaces to cause the machine 100 to perform one or more operations associated with the machine 100. As an example, the operator may interact with the one or more operator interfaces to propel the machine 100 over the ground surface 106, to maneuver the machine 100, and/or to control one or more implements associated with the machine 100, as described in more detail elsewhere herein.

As further shown in FIG. 1, the machine 100 includes a work implement assembly 130 having a lift arm 132 and a bucket 134. As an example, the lift arm 132 and the bucket 134 may be used to lift, haul, and/or dump materials associated with the worksite, as described in more detail elsewhere herein. The lift arm 132 includes a first end 136 and a second end 138. The first end 136 is pivotally connected to the front end 114 of the frame 102 by a first pivot joint 140, which enables the lift arm 132 to be pivotally raised and lowered with respect to the frame 102 and the ground surface 106. The bucket 134 is pivotally connected to the second end 138 of the lift arm 132 by a second pivot joint 142, which enables the bucket 134 to be tilted with respect to the lift arm 132.

As further shown in FIG. 1, the machine 100 includes a prime mover 150 (e.g., an internal combustion engine, among other examples) disposed on the rear end 112 of the frame 102 and a hydraulic system 152 (e.g., associated with enhanced electrical control, as described in more detail elsewhere herein) operatively connected to the prime mover 150. The hydraulic system 152 includes a first hydraulic actuator 154 and a second hydraulic actuator 156. The first hydraulic actuator 154 is operatively connected to the lift arm 132 and the front end 114 of the frame 102. The first hydraulic actuator 154 may extend and retract (e.g., in a telescoping manner) to cause the lift arm 132 to pivot with respect to the first pivot joint 140 to raise and lower the bucket 134.

The second hydraulic actuator 156 is operatively connected to the lift arm 132 and the bucket 134. The second hydraulic actuator 154 may extend and retract to pivot the bucket 134 about the second pivot joint 142. Although the hydraulic system 152 includes a first hydraulic actuator 154 and a second hydraulic actuator 156 as described in connection with FIG. 1, the hydraulic system 152 may include any suitable hydraulic actuators and/or hydraulic actuator configurations.

As further shown in FIG. 1, the machine 100 includes a controller 158 (e.g., an electronic control module (ECM), among other examples). The controller 158 may include one or more memories (e.g., one or more non-transitory computer-readable mediums) and one or more processors communicatively coupled to the one or more memories. Communicative coupling between the one or more processors and the one or more memories may enable the one or more processors to read and/or process information stored in the one or more memories and/or to store information in the one or more memories.

In some implementations, the one or more memories may include one or more volatile and/or nonvolatile memories. For example, the one or more memories may include one or more random access memories (RAMs), read only memories (ROMs), hard disk drives, and/or other types of memories (e.g., flash memories, magnetic memories, and/or optical memories). The one or more memories may include one or more internal memories (e.g., one or more RAMs, ROMs, or hard disk drives) and/or one or more removable memories (e.g., removable via universal serial bus connections. The one or more memories may store information, one or more instructions, and/or software (e.g., one or more software applications) related to the operation of the controller 158.

The controller 158 may include an input component that enables the controller 158 to receive input, such as operator input and/or sensed input. For example, the input component may include a touch screen, a keyboard, a keypad, a mouse, a button, a microphone, a switch, a sensor, a global positioning system sensor, an accelerometer, a gyroscope, and/or an actuator, among other examples.

The controller 158 may include an output component that enables the controller 158 to provide output, such as via a display, a speaker, and/or a light-emitting diode. The controller 158 may include a communication component that enables the controller 158 to communicate with other devices via a wired connection and/or a wireless connection. For example, the communication component may include a receiver, a transmitter, a transceiver, a modem, a network interface card, and/or an antenna, among other examples.

In some implementations, the controller 158 may be communicatively coupled to one or more sensors (e.g., shown as sensors 160 in FIG. 1) associated with the machine 100 and/or one or more components of the machine 100 (e.g., the work implement assembly 130 and/or the hydraulic system 152, among other examples). Accordingly, for example, the one or more sensors 160 may include one or more implement position sensors (e.g., to detect one or more positions or orientations associated with the work implement assembly 130) pressure sensors (e.g., to measure one or more pressures associated with the hydraulic system 152 and/or the work implement assembly 130), flow sensors (e.g., to measure one or more flow rates of fluid associated with the hydraulic system 152) and/or implement engagement sensors (e.g., to measure one or more engagement indicators or disengagement indicators associated with the work implement assembly 130), among other examples.

The controller 158 may communicate with the one or more sensors 160 to perform one or more operations and/or processes, as described in more detail elsewhere herein. As an example, the one or more sensors 160 may send, and the controller 158 may receive, the information associated with the machine 100 and/or the work implement assembly 130, as described in more detail elsewhere herein.

In some implementations, the controller 158 may receive one or more inputs (e.g., one or more operator inputs via the one or more operator interfaces and/or one or more sensor inputs from the one or more sensors 160, among other examples), and, based on the one or more inputs, the controller 158 may control the hydraulic system 152, as described in more detail elsewhere herein. As indicated above, FIG. 1 is provided as an example. Other examples may differ from what was described in connection with FIG. 1.

Figure 2:
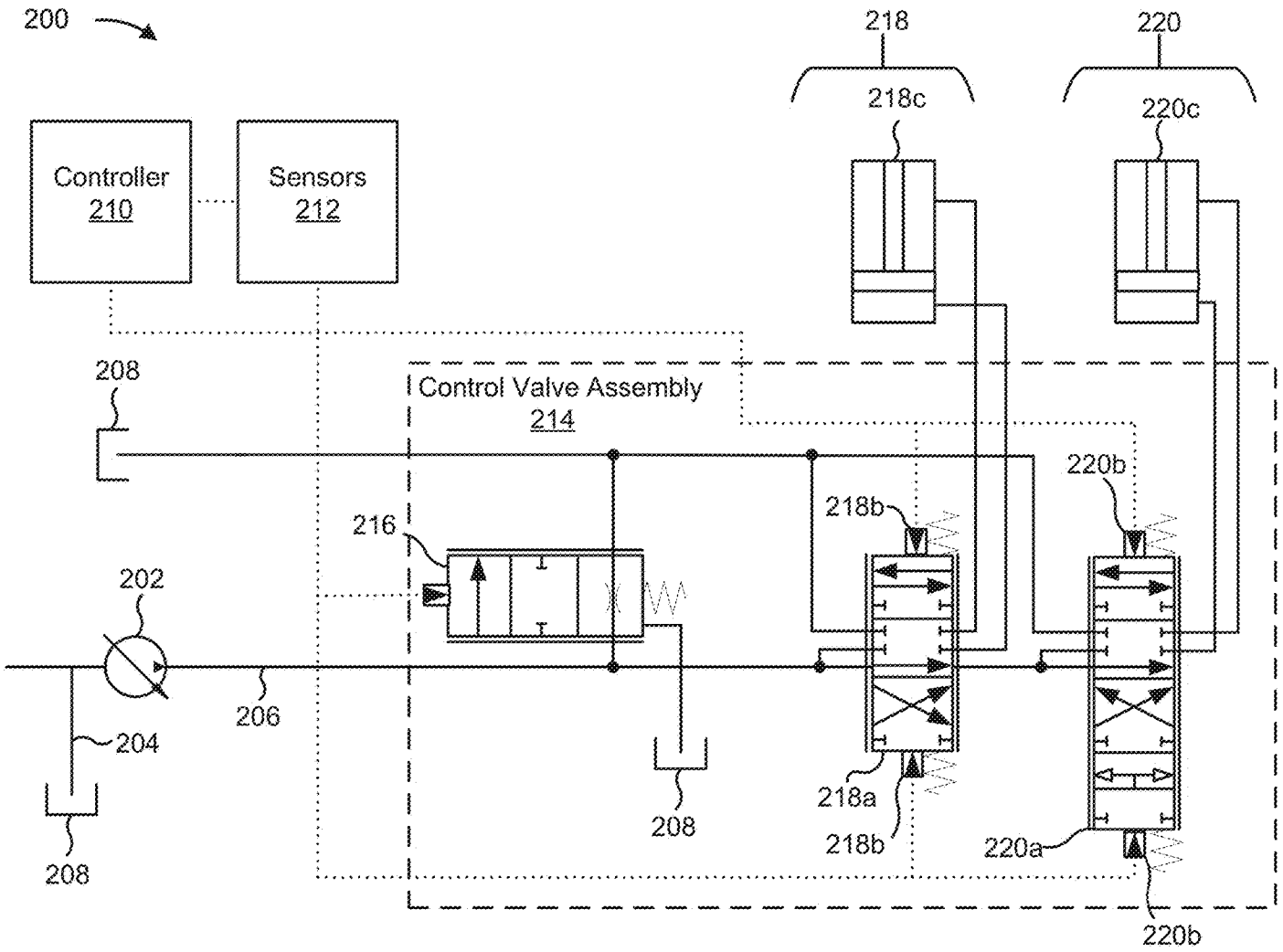
FIG. 2 is a diagram of an example hydraulic system, in accordance with some embodiments of the present disclosure.

FIG. 2 is a diagram of an example hydraulic system 200 (e.g., which may correspond to the hydraulic system 152 of the machine 100 of FIG. 1) associated with enhanced electrical control (e.g., which enables reduced fluid losses to tank and improved efficiency). As shown in FIG. 2, the hydraulic system 200 includes a hydraulic pump 202, a feed line 204, a main line 206, a tank 208 (e.g., a fluid reservoir), a controller 210 (e.g., which may correspond to the controller 158 of FIG. 1), sensors 212 (e.g., which may correspond to sensors 160), and a control valve assembly 214.

As further shown in FIG. 2, the control valve assembly 214 includes an unloading valve 216 (e.g., shown as a three position, six-way electrohydraulic proportional control valve in FIG. 2), a first hydraulic circuit 218, and a second hydraulic circuit 220. The unloading valve 216 is in fluid communication with the hydraulic pump 202, the tank 208, the first hydraulic circuit 218 and the second hydraulic circuit 220. The first hydraulic circuit 218 includes a first circuit valve **218*a* (e.g., shown as a three position, six-way electrohydraulic proportional control valve in FIG. 2), a first valve control device 218*b* (shown as a solenoid in FIG. 2), and a first hydraulic actuator 218*c* (e.g., shown as a cylinder in FIG. 2 and which may correspond to the first hydraulic actuator 154 of FIG. 1). The second hydraulic circuit 220 includes a second circuit valve 220*a* (e.g., shown as a four position, six-way electrohydraulic proportional control valve in FIG. 2), a second valve control device 220*b* (e.g., shown as a solenoid in FIG. 2), and a second hydraulic actuator 220*c* (e.g., shown as a cylinder in FIG. 2 and which may correspond to the second hydraulic actuator 156 of FIG. 1**).

Although the unloading valve 216 is shown and described as a three position, six-way electrohydraulic proportional control valve, the first circuit valve **218*a* is shown and described as a three position, six-way electrohydraulic proportional control valve, the first valve control device 218*b* is shown and described as a solenoid, the first hydraulic actuator 218*c* is shown an described as a cylinder, the second circuit valve 220*a* is shown and described as a four position, six-way electrohydraulic proportional control valve, the second valve control device 220*b* is shown and described as a solenoid, and the second hydraulic actuator 220*c* is shown and described as a cylinder in connection with FIG. 2, the unloading valve 216, the first circuit valve 218*a* and the second circuit valve 220*a* may be any suitable circuit valves, the first valve control device 218*b* and the second valve control device 220*b* may be any suitable valve control devices, and the first hydraulic actuator 218*c* and the second hydraulic actuator 220*c*** may be any suitable hydraulic actuators.

As further shown in FIG. 2, the feed line 204 is fluidly coupled to the tank 208 and to an intake end of the hydraulic pump 202, and the main line 206 is fluidly coupled to a discharge end of the hydraulic pump 202. The hydraulic pump 202 may draw, via the feed line 204, fluid from the tank 208. The hydraulic pump 202 may pressurize the fluid and may discharge the pressurized fluid through the discharge end to the main line 206. The controller 210 may be configured to control the flow of pressurized fluid through the main line 206 and the control valve assembly 214 (e.g., through the unloading valve 216, the first hydraulic circuit 218, and the second hydraulic circuit 220) and back to the tank 208, as described in more detail elsewhere herein.

In some implementations, the first circuit valve **218*a* and the controller 210 may control the first circuit valve 218*a* via the first valve control device 218*b* and may control the second circuit valve 220*a* via the second valve control device 220***b*. As an example, the controller 210 may send, and the first valve control device 218*b* may receive, instructions (e.g., one or more commands associated with the hydraulic system 200) that cause the first valve control device 218*b* to control the first circuit valve 218*a*. As another example, the controller 210 may send, and the second valve control device 220*b* may receive, instructions that cause the second valve control device 220*b* to control the second circuit valve 220*a*.

The controller 210 may cause (e.g., based on the instructions) the first valve control device 218*b* to configure or position one or more components (e.g., spools, stems, actuators, plugs, and/or apertures, among other examples) of the first circuit valve 218*a* to increase or decrease an opening associated with the first circuit valve 218*a*. The controller 210 may cause the second valve control device 220*b* to configure or position one or more components of the second circuit valve 220*a* to increase or decrease an opening associated with the second circuit valve 220*a*.

In some implementations, first hydraulic circuit 218 and the second hydraulic circuit 220 may be associated with individual functions of a machine (e.g., the machine of FIG. 1) and/or a work implement assembly (e.g., the work implement assembly 130 of FIG. 1). As an example, the first hydraulic circuit 218 may be associated with controlling a lift arm (e.g., the lift arm 132 of FIG. 1) of the machine and the second hydraulic circuit 220 may be associated with controlling a bucket of the machine (e.g., the bucket 134 of FIG. 1). Accordingly, for example, the first hydraulic actuator 218*c* and the second hydraulic actuator 220*c* may each be displaceable between a minimum position and a maximum position.

In this way, the first hydraulic actuator 218*c* may be used to control displacement (e.g., or movement) of the lift arm 132 (e.g., a lift movement) between a minimum position and a maximum position) and the second hydraulic actuator 220*c* may be used to control displacement of the bucket 134 (e.g., a tilt movement) between a minimum movement and a maximum movement. In some implementations, the hydraulic system 200 may use the unloading valve 216 to prevent pressurized fluid from flowing to the tank during displacement (e.g., partial displacement) of the lift arm 132 and/or during displacement (e.g., partial displacement) of the bucket 134, as described in more detail elsewhere herein.

Although the first hydraulic circuit 218 is described as controlling the lift arm of the machine and the second hydraulic circuit 220 is described as controlling the bucket of the machine, the first hydraulic circuits 214 and the second hydraulic circuit 220 may control any suitable hydraulic function associated with the machine and/or the work implement assembly. As an example, the first hydraulic circuit 218 and/or the second hydraulic circuit 220 may be used to control directional movement of the machine, to control swing (or rotation) of the machine body, to control a boom of the machine, and/or a stick of the machine, among other examples).

In some implementations, the sensors 212 may include pressure sensors that monitor pressures associated with the hydraulic system 200 (e.g., individual pressures of the first hydraulic circuit 218 and/or the second hydraulic circuit 220, among other examples). As an example, the sensors 212 may measure and/or indicate a pressure at a rod end of cylinder first hydraulic actuator 218*c* and/or the second hydraulic actuator 220*c*, a pressure at a head end of the first hydraulic cylinder 218*c* and/or the second hydraulic actuator 220*c*, a pressure within a circuit line between the first circuit valve 218*a* and the first hydraulic actuator 218*c*, and/or a pressure within a circuit line between the second circuit valve 220*a* and the second hydraulic actuator 220*c*. As further shown in FIG. 2, the sensors 212 are communicatively coupled to the controller 210. Accordingly, for example, the sensors 212 may send, and the controller 210 may receive, measurements (e.g., pressure measurements) associated with the hydraulic system 200. The controller 210 may generate instructions based on the pressure measurements.

In some implementations, the unloading valve 216 may regulate a flow of the pressurized fluid to the tank 208 (e.g., based on an operation mode of the hydraulic system 200, as described in more detail elsewhere herein). As an example, the unloading valve 216 may include a spool that is operated by an electrohydraulic solenoid (e.g., via instructions provided to the electrohydraulic solenoid by the controller 210). Accordingly, for example, the hydraulic system 200 may control the spool to operate the hydraulic system 200 in one or positions (e.g., associated with one or more operation modes and/or system modes, among other examples).

As an example, the hydraulic system 200 may cause the unloading valve 216 to operate in a first position (e.g., that provides a partial restriction for neutral bleed and/or bypass controls, among other examples), may cause the unloading valve 216 to operate in a second position (e.g., to fully close an opening of the unloading valve 216, which reduces or eliminates parasitic losses during implement commands and/or during partial implement commands, among other examples), and/or may cause the unloading valve to operate in a third position (e.g., to provide a sufficient opening area of the unloading valve 216 to facilitate an unloading function or capability during a cold engine start of the machine of FIG. 1, among other examples).

In other words, the hydraulic system 200 may operate the unloading valve 216 in one or more operation modes based on one or more inputs associated with the hydraulic system (e.g., the hydraulic system 200 may use control logic to shift the spool of the unloading valve in one or more positions based on the one or more inputs). In this way, the hydraulic system 200 may use enhanced electrical control of the unloading valve 216 to provide variable unloading functionality associated with the hydraulic system 200.

Thus, in some implementations, the unloading valve 216 may be proportionally controllable (e.g., the unloading valve may be operable in multiple positions). For example, the unloading valve 216 may be operable in a first position, a second position, and a third position (e.g., in association with, and/or based on, one or more operations modes of the hydraulic system). As an example, the unloading valve 216 may be operable in the first position to direct the pressurized flow of fluid to the tank 208 at a first pressure associated with the hydraulic system, may be operable in the second position to prevent the pressurized fluid from flowing to the tank 208 (e.g., during displacement of the actuator between the minimum position and the maximum position, among other examples), and/or may be operable in the third position to direct the flow of pressurized fluid to the tank 208 at a second pressure associated with the hydraulic system that is lower than the first pressure. As an example, the first pressure may be associated with at least one of a standby operation mode of the hydraulic system or a bypass operation mode of the hydraulic system.

As another example, the second pressure may be associated with an unloading operation mode of the hydraulic system 200. In this way, the controller 210 may cause the unloading valve 216 to operate in the first position to enable the hydraulic system 200 to operate in the standby or bypass operation mode, to operate in the second position to mitigate (or eliminate) parasitic losses during actuator commands, and/or to operate in the third position to enable the hydraulic system 200 to operate in the unloading operation mode. Accordingly, for example, the controller 210 may be configured determine an operation mode associated with the hydraulic system, and based on the operation mode, may cause the unloading valve 216 to operate in one or more positions (e.g., the first position, the second position, or the third position, among other examples).

In some implementations, the hydraulic system 200 may be a proportional flow control (PFC) hydraulic system (e.g., a hydraulic system that proportionally controls a flow rate and/or a direction of hydraulic fluid within the hydraulic system) and the control valve assembly 214 may be a PFC control valve assembly. The PFC hydraulic system may use the unloading valve 216 to operate the PFC hydraulic system in a standby operation mode or bypass operation mode (e.g., associated with the unloading valve 216 operating in the first position), a command operation mode (e.g., a partial command operation mode associated with the unloading valve 216 operating in the second position during partial actuator commands), and/or an unloading operation mode (e.g., associated with the unloading valve 216 operating in the third position) rather than using a restriction (e.g., in a last spool section of a typical PFC control valve assembly) to enable the standby or bypass operation mode, rather than directing pressurized fluid to a tank during partial actuator commands (e.g., because the typical PFC valve control assembly does not fully close during the partial actuator commands), and rather than using separate valve unloading components (e.g., in the typical PFC control valve assembly) to enable the unloading operation mode. As indicated above, FIG. 2 is provided as an example. Other examples may differ from what was described in connection with FIG. 2.

Figure 3:
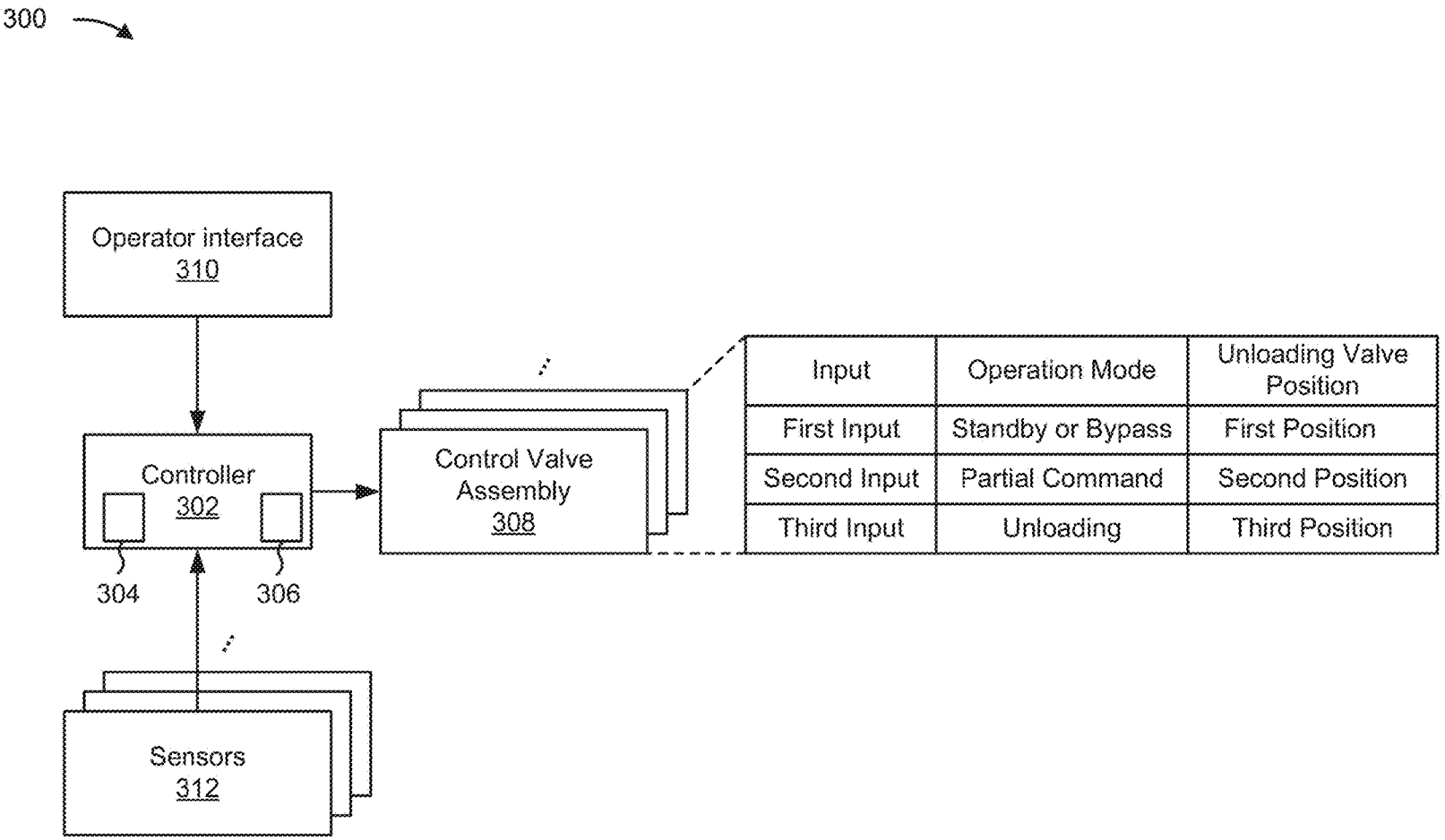
FIG. 3 is a diagram of an example system in which example devices and/or methods described herein may be implemented.

FIG. 3 is a diagram of an example system 300 (e.g., which may correspond to the hydraulic system 152 of FIG. 1 and/or the hydraulic system 200 of FIG. 2) in which example devices and/or example methods, described herein, may be implemented. As shown in FIG. 3, the system 300 may include a controller 302 (e.g., which may correspond to the controller 158 of FIG. 1 and/or the controller 210 of FIG. 2) that includes a processor 304 and a memory 306.

The processor 304 (e.g., of the controller 302) may be implemented in hardware, firmware, and/or a combination of hardware and software. The processor 304 may include a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. The processor 304 may include one or more processors capable of being programmed to perform a function. The memory 306 (e.g., of the controller 302) may include a random-access memory (RAM), a read only memory (ROM), and/or another type of dynamic or static storage device (e.g., a flash memory, a magnetic memory, and/or an optical memory) that stores information and/or instructions for use by processor 304 (e.g., information and/or instructions associated with the system 300 and/or one or more components associated with the system 300, among other examples).

As further shown in FIG. 3, the system 300 includes a control valve assembly 308 (e.g., which may correspond to the control valve assembly 214 of FIG. 2), an operator interface 310 (e.g., which may correspond to the operator interface 122 and/or one or more operator interfaces as described in more detail elsewhere herein), and sensors 312 (e.g., which may correspond to the sensors 160 of FIG. 1 and/or the sensors 212 of FIG. 2).

In some implementations, the control valve assembly 308 may include an unloading valve (e.g., the unloading valve 216 of FIG. 2), one or more hydraulic circuits (e.g., the first hydraulic circuit 218 and/or the second hydraulic circuit 220 of FIG. 2, and/or one or more hydraulic components (e.g., the first control valve 218*a*, the first control valve device 218*b*, the first hydraulic actuator 218*c*, the second control valve 220*a*, the second control valve device 220*b*, and/or the second hydraulic actuator 220*c* of FIG. 2), among other examples. Furthermore, devices of the system 300 may interconnect via wired connections, wireless connections, or a combination of wired and wireless connections. The control valve assembly 308 may be in fluid communication with a hydraulic pump (e.g., the hydraulic pump 202 of FIG. 2) and a tank (e.g., the tank 208 of FIG. 2).

In some implementations, the system 300 may operate in a first mode (e.g., a standby operation mode or a bypass operation mode), a second mode (e.g., a partial command operation mode), or a third mode (e.g., an unloading operation mode). The standby operation mode or the bypass operation mode may be associated with maintaining fluid at a specific pressure or allowing pressurized fluid to flow to a tank at a specified pressure level (e.g., to ensure that the system 300 remains ready for immediate use while preventing over-pressurization or excessive heat generation). The command operation mode (e.g., the partial command operation mode) may be associated with control actions that are related to movements (e.g. partial movements) of one or more components of the system 300 (e.g., one or more hydraulic components associated with the system 300). The unloading operation mode may be associated with reducing a load on an engine during a cold engine start of the machine.

In some implementations, the controller 302 may receive (e.g., from the operator interface 310 and/or from the sensors 312) one or more inputs associated with the system 300 (e.g., one or more inputs associated with an operator input, a sensor input, an operating condition, and/or an operating requirement, among other examples). Based on the one or more inputs, may determine an unloading pressure of the unloading valve at which to direct pressurized fluid to the tank. Thus, for example, the controller 302 may determine that the operating mode is the standby operation mode or the bypass operation mode based on receiving an operator input indicating a need for pressure readiness associated with an implement (e.g., the operator may interact with an operator interface associated with indicating that the operator intends to use an implement of a machine), a sensor measurement indicating a need for pressure readiness associated with the implement (e.g., a sensor measurement indicating that an implement has been operatively connected to a machine), and/or a sensor measurement indicating an overpressure event, among other examples.

As another example, the controller 302 may determine that the operation mode is the command operation mode (e.g., the partial command operation mode) based on the controller 302 receiving an input indicating a desired displacement of an actuator related to a hydraulic circuit of the hydraulic system (e.g., that is less than a maximum displacement of the actuator). As another example, the controller 302 may determine that the operation mode is the unloading operation mode based on an input indicating that a temperature associated with an engine satisfies a threshold (e.g., the temperature associated with the engine is below or equal to a temperature threshold), among other examples.

In some implementations, the controller 302 may proportionally control the unloading valve between multiple positions to regulate a flow of the pressurized fluid to the tank. As an example, the controller 302 may operate the unloading valve in a first position (e.g., based on one or more inputs and/or the standby operation mode), a second position (e.g., based on the one or more inputs, the command operation mode, and/or the partial command operation mode, among other examples), or a third position (e.g., based on the one or more inputs and/or the unloading operation mode). As an example, the controller 302 may send, and the unloading valve may receive, instructions that cause the unloading valve to operate in the first position based on a first input and/or the standby operation mode, to operate in the second position based on a second input and/or the command operation mode (e.g., the partial command operation mode), or to operate in the third position based on a third input and/or the unloading operation mode.

Accordingly, for example, when the unloading valve is in the first position, the unloading valve may be partially open to direct fluid to the tank. As another example, when the unloading valve is in the second position, the unloading valve may be closed (e.g., fully closed) to prevent fluid from flowing to the tank. In this way, parasitic losses are mitigated and efficiency of the system 300 is improved. As another example, when the unloading valve is in the third position, the unloading valve may be open to provide unloading capability (e.g., during a cold engine start).

In some implementations, the controller 302 may cause the unloading valve to operate in a closed position that prevents the pressurized fluid from flowing to the tank based on determining that unloading pressure is a zero pressure (e.g., during displacement of the actuator between a minimum position and a maximum position). In other words, during actuator commands (e.g., partial actuator commands), the controller 302 may use the unloading valve to prevent the pressurized fluid from being directed to the tank, which mitigates (or eliminates) parasitic losses and improves efficiency of the system 300.

As another example, the controller 302 may cause, based on determining that the unloading pressure is a standby pressure associated with a standby operation mode of the hydraulic system, the unloading valve to operate in an open position that directs the pressurized fluid to the tank at the standby pressure. As another example, the controller 302 may cause, based on determining that the unloading pressure is an unloading pressure associated with an unloading operation mode of the hydraulic system, the unloading valve to operate in an open position that directs the pressurized fluid to the tank at the unloading pressure.

To operate the system 300 in the standby operation mode or bypass operation mode, the controller 302 may cause the unloading valve to operate in the first position based on a first input. To operate the system 300 in the command operation mode (e.g., the partial command operation mode), the controller 302 may cause the unloading valve to operate in the second position based on a second input. To operate the system 300 in the unloading operation mode, the controller 302 may cause the unloading valve to operate in the third position based on a third input.

The number and arrangement of devices shown in FIG. 3 are provided as an example. In practice, there may be additional devices, fewer devices, different devices, or differently arranged devices than those shown in FIG. 3. Furthermore, two or more devices shown in FIG. 3 may be implemented within a single device, or a single device shown in FIG. 3 may be implemented as multiple, distributed devices. Additionally, or alternatively, a set of devices (e.g., one or more devices) of the system 300 may perform one or more functions described as being performed by another set of devices of the system 300.

INDUSTRIAL APPLICABILITY

As noted above, the disclosed subject matter relates to a hydraulic system with enhanced electrical control. The hydraulic system may be used by any machine (e.g., a wheel loader, among other examples. Generally, the hydraulic system may use enhanced electrical control of an unloading valve (e.g., of a control valve assembly associated with the hydraulic system) to provide variable unloading functionality associated with the hydraulic system. This enables the hydraulic system to mitigate (or eliminate) parasitic losses (e.g., during partial actuator commands) and improve efficiency of the hydraulic system.

Accordingly, in some implementations, the hydraulic system may include a tank to store a supply of fluid, a pump to supply pressurized fluid, an actuator that is displaceable within a range from a minimum position to a maximum position, an unloading valve positioned between the pump and the tank, and a controller. The unloading valve 216 may be proportionally controllable (e.g., the unloading valve may be operable in multiple positions to regulate a flow of the pressurized fluid to the tank). For example, the unloading valve may be operable in a first position to direct the pressurized flow of fluid to the tank at a first pressure associated with the hydraulic system, may be operable in a second position to prevent the pressurized fluid from flowing to the tank during displacement of the actuator between the minimum position and the maximum position, and/or may be operable in a third position to direct the flow of pressurized fluid to the tank at a second pressure associated with the hydraulic system that is lower than the first pressure, as described in more detail elsewhere herein.

In some implementations, the hydraulic system may be a PFC hydraulic system and the unloading valve may be associated with a PFC control valve assembly. The PFC hydraulic system may use the unloading valve to operate the PFC hydraulic system in a standby operation mode or bypass operation mode (e.g., associated with the unloading valve operating in the first position), a command operation mode (e.g., a partial command operation mode associated with the unloading valve operating in the second position during partial actuator commands), and/or an unloading operation mode (e.g., associated with the unloading valve operating in the third position) rather than using a restriction (e.g., in a last spool section of a typical PFC control valve assembly) to enable the standby or bypass operation mode, rather than directing pressurized fluid to a tank during actuator commands (e.g., because the typical PFC valve control assembly does not fully close during the actuator commands), and rather than using separate valve unloading components (e.g., in the typical PFC control valve assembly) to enable the unloading operation mode.

Figure 4:
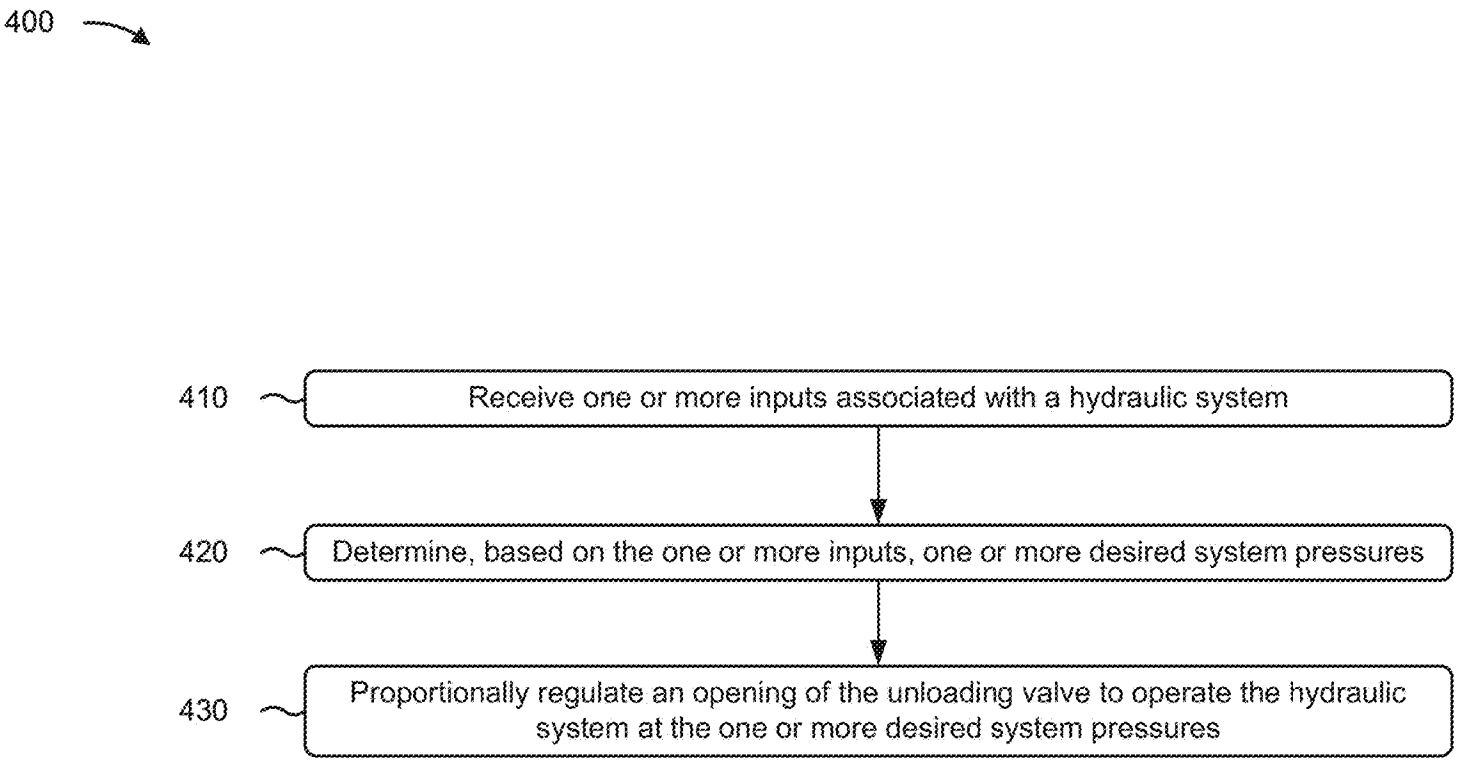
FIG. 4 is a flowchart of an example process associated with reducing parasitic losses associated with a hydraulic system, in accordance with some embodiments of the present disclosure.

FIG. 4 is a flowchart of an example process 400 associated with enhanced electrical control of a hydraulic system. In some implementations, one or more process blocks of FIG. 4 may be performed by a hydraulic system (e.g., the hydraulic system 152 of FIG. 1, the hydraulic system 200 of FIG. 2 and/or the system 300 of FIG. 3). In some implementations, one or more process blocks of FIG. 4 may be performed by another device, or a group of devices separate from or including the hydraulic system, such as a controller (e.g., the controller 158 of FIG. 1, the controller 210 of FIG. 2, and/or the controller 302 of FIG. 3).

As shown in FIG. 4, process 400 may include receiving one or more inputs associated with a hydraulic system (block 410). For example, a controller of the hydraulic system may receive one or more inputs associated with the hydraulic system, as described above. In some implementations, the hydraulic system may include a tank, a pump, an actuator (e.g., an implement actuator), and an unloading valve positioned between the tank and the pump. The one or more inputs may be associated with one or more operating conditions of the hydraulic system. In some implementations, the hydraulic system may be a PFC hydraulic system, and the input may be associated with a command (e.g., a partial command) associated with a desired displacement (e.g., a desired partial displacement) of an implement actuator associated with controlling an implement of a machine, as described in more detail elsewhere herein.

As further shown in FIG. 4, process 400 may include determining, based on the one or more inputs, one or more desired system pressures (block 420). For example, the controller may determine, based on the one or more inputs, one or more desired system pressures, as described above. As an example, the one or more desired system pressures may be associated with at least one of a standby pressure, an operating pressure associated with an implement command of an implement of the hydraulic system, or an unloading pressure. As another example, the one or more desired system pressures may be associated with one or more operating modes of the hydraulic system.

In some implementations, the hydraulic system may be associated with a machine, and the one or more inputs are associated with at least one of an operator input associated with at least one of an operator interface of the machine, a sensor device input associated with a sensor device of at least one of the hydraulic system or the machine, or an operating condition associated with at least one of the hydraulic system or the machine.

As further shown in FIG. 4, process 400 may include proportionally regulating an opening of the unloading valve to operate the hydraulic system at the one or more desired system pressures (block 430). For example, the controller may include proportionally regulating an opening of the unloading valve to operate the hydraulic system at the one or more desired system pressures, as described above. In some implementations, to proportionally regulate the opening of the unloading valve to operate the hydraulic system at the one or more desired system pressures, the controller may proportionally regulate the opening at least between a closed position and a partially open position.

Although FIG. 4 shows example blocks of process 400, in some implementations, process 400 may include additional blocks, fewer blocks, different blocks, or differently arranged blocks than those depicted in FIG. 4. Additionally, or alternatively, two or more of the blocks of process 400 may be performed in parallel.

In this way, the hydraulic system may use the unloading valve to operate the hydraulic system in one or more operation modes (e.g., based on one or more inputs associated with the hydraulic system). As an example, the hydraulic system may use control logic to operate the unloading valve in one or more positions based on the one or more inputs. In other words, the hydraulic system may use enhanced electrical control of the unloading valve 216 to provide variable unloading functionality associated with the hydraulic system. This enables the hydraulic system to mitigate (or eliminate) parasitic losses (e.g., during partial actuator commands) and improve efficiency of the hydraulic system.

Embodiments of the disclosed subject matter can also be as set forth according to the following parentheticals.

(1) A hydraulic system, comprising: a tank to store a supply of fluid; a pump to supply pressurized fluid; an actuator that is displaceable within a range from a minimum position to a maximum position; an unloading valve positioned between the pump and the tank, wherein the unloading valve includes an opening that is proportionally controllable; and a controller configured to: receive one or more inputs associated with the hydraulic system; determine, based on the one or more inputs, one or more desired system pressures of the hydraulic system; and control the opening of the unloading valve to operate the hydraulic system at the one or more desired system pressures.

(2) The hydraulic system according to (1), wherein the one or more inputs are associated with one or more operating conditions of the hydraulic system.

(3) The hydraulic system according to any one of (1) to (2), wherein the one or more desired pressures are associated with at least one of: a standby pressure, an operating pressure associated with an implement command of an implement of the hydraulic system, or an unloading pressure.

(4) The hydraulic system according to any one of (1) to (3), wherein, to control the opening of the unloading valve to operate the hydraulic system at the one or more desired system pressures, the controller is configured to: cause the opening to move between a closed position and a partially open position.

(5) The hydraulic system according to any one of (1) to (4), wherein the one or desired system pressures are associated with one or more operating modes of the hydraulic system.

(6) The hydraulic system according to any one of (1) to (5), wherein the one or more desired system pressures include a first system pressure and a second system pressure that is different than the first system pressure.

(7) The hydraulic system according to any one of (1) to (6), wherein the actuator is an implement actuator.

(8) A method for controlling a hydraulic system, the hydraulic system including a controller, a tank, a pump, and an unloading valve positioned between the tank and the pump, the method comprising: receiving, by the controller, one or more inputs associated with the hydraulic system; determining, by the controller and based on the one or more inputs, one or more desired system pressures associated with the hydraulic system; and proportionally regulating, by the controller, an opening of the unloading valve to operate the hydraulic system at the one or more desired system pressures.

(9) The method according to (8), wherein the one or more inputs are associated with one or more operating conditions of the hydraulic system.

(10) The method according to any one of (8) to (9), wherein proportionally regulating, by the controller, the opening of the unloading valve to operate the hydraulic system at the one or more desired system pressures comprises: proportionally regulating the opening at least between a closed position and a partially open position.

(11) The method according to any one of (8) to (10), wherein the one or more desired system pressures are associated with at least one of: a standby pressure, an operating pressure associated with an implement command of an implement of the hydraulic system, or an unloading pressure.

(12) The method according to any on of (8) to (11), wherein the hydraulic system is associated with a machine, and wherein the one or more inputs are associated with at least one of: an operator input associated with at least one of an operator interface of the machine, a sensor device input associated with a sensor device of at least one of the hydraulic system or the machine, or an operating condition associated with at least one of the hydraulic system or the machine.

(13) The method according to any one of (8) to (12), wherein the one or more desired system pressures are associated with one or more operating modes of the hydraulic system.

(14) The method according to any one of (8) to (13), wherein the actuator is an implement actuator.

(15) A machine, comprising: a hydraulic system including: a tank to store a supply of fluid; a pump to supply pressurized fluid; an actuator that is displaceable from a minimum position to a maximum position; an unloading valve, positioned between the pump and the tank, including an opening that is proportionally controllable; and a controller configured to: receive one or more inputs associated with at least one of the machine or the hydraulic system; determine, based on the one or more inputs, one or more desired system pressures associated with at least one of the machine or the hydraulic system; and control the opening of the unloading valve to operate the hydraulic system at the one or more desired system pressures.

(16) The machine according to (15), wherein the one or more desired system pressures are associated with at least one of: a standby pressure, an operating pressure associated with an implement command of an implement of the hydraulic system, or an unloading pressure.

(17) The machine according to any one of (15) to (16), to control the opening of the unloading valve to operate the hydraulic system at the one or more desired system pressures, the controller is configured to: cause the opening of the unloading valve to close to prevent the pressurized fluid from flowing to the tank during displacement of the actuator between the minimum position and the maximum position.

(18) The machine according to any one of (15) to (17), wherein the one or more inputs are associated with at least one of: an operator input associated with at least one of an operator interface of the machine, a sensor device input associated with a sensor device of at least one of the hydraulic system or the machine, or an operating condition associated with at least one of the hydraulic system or the machine.

(19) The machine according to any one of (15) to (18), wherein the opening of the unloading valve is movable between at least a closed position and a partially open position.

(20) The machine according to any one of (15) to (19), wherein the actuator is an implement actuator.

As used herein, the term "component" is intended to be broadly construed as hardware, firmware, or a combination of hardware and software. It will be apparent that systems and/or methods described herein may be implemented in different forms of hardware, firmware, and/or a combination of hardware and software. The actual specialized control hardware or software code used to implement these systems and/or methods is not limiting of the implementations. Thus, the operation and behavior of the systems and/or methods are described herein without reference to specific software code—it being understood that software and hardware can be used to implement the systems and/or methods based on the description herein.

As used herein, satisfying a threshold may, depending on the context, refer to a value being greater than the threshold, greater than or equal to the threshold, less than the threshold, less than or equal to the threshold, equal to the threshold, not equal to the threshold, or the like.

To the extent the aforementioned implementations collect, store, or employ personal information of individuals, it should be understood that such information shall be used in accordance with all applicable laws concerning protection of personal information. Additionally, the collection, storage, and use of such information can be subject to consent of the individual to such activity, for example, through well known "opt-in" or "opt-out" processes as can be appropriate for the situation and type of information. Storage and use of personal information can be in an appropriately secure manner reflective of the type of information, for example, through various encryption and anonymization techniques for particularly sensitive information.

Even though particular combinations of features are recited in the claims and/or disclosed in the specification, these combinations are not intended to limit the disclosure of various implementations. In fact, many of these features may be combined in ways not specifically recited in the claims and/or disclosed in the specification. Although each dependent claim listed below may directly depend on only one claim, the disclosure of various implementations includes each dependent claim in combination with every other claim in the claim set. As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiple of the same item.

When "a processor" or "one or more processors" (or another device or component, such as "a controller" or "one or more controllers") is described or claimed (within a single claim or across multiple claims) as performing multiple operations or being configured to perform multiple operations, this language is intended to broadly cover a variety of processor architectures and environments. For example, unless explicitly claimed otherwise (e.g., via the use of "first processor" and "second processor" or other language that differentiates processors in the claims), this language is intended to cover a single processor performing or being configured to perform all of the operations, a group of processors collectively performing or being configured to perform all of the operations, a first processor performing or being configured to perform a first operation and a second processor performing or being configured to perform a second operation, or any combination of processors performing or being configured to perform the operations. For example, when a claim has the form "one or more processors configured to: perform X; perform Y; and perform Z," that claim should be interpreted to mean "one or more processors configured to perform X; one or more (possibly different) processors configured to perform Y; and one or more (also possibly different) processors configured to perform Z."

No element, act, or instruction used herein should be construed as critical or essential unless explicitly described as such. Also, as used herein, the articles "a" and "an" are intended to include one or more items, and may be used interchangeably with "one or more." Further, as used herein, the article "the" is intended to include one or more items referenced in connection with the article "the" and may be used interchangeably with "the one or more." Furthermore, as used herein, the term "set" is intended to include one or more items (e.g., related items, unrelated items, or a combination of related and unrelated items), and may be used interchangeably with "one or more." Where only one item is intended, the phrase "only one" or similar language is used. Also, as used herein, the terms "has," "have," "having," or the like are intended to be open-ended terms. Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

In the preceding specification, various example embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. A hydraulic system, comprising:
a tank to store a supply of fluid;
a pump to supply pressurized fluid;
an actuator that is displaceable within a range from a minimum position to a maximum position;
a control valve assembly including:
an unloading valve between the pump and the tank, wherein the unloading valve is directly fluidly coupled to the pump and the tank and includes an opening that is proportionally controllable,
a first circuit valve directly fluidly coupled to the pump and the tank, and
a second circuit valve directly fluidly coupled to the tank and an output of the first circuit valve; and
a controller configured to:
receive one or more inputs associated with the hydraulic system;
determine, based on the one or more inputs, one or more desired system pressures of the hydraulic system; and
control the opening of the unloading valve to operate the hydraulic system at the one or more desired system pressures.

2. The hydraulic system of claim 1, wherein the one or more inputs are associated with one or more operating conditions of the hydraulic system.

3. The hydraulic system of claim 1, wherein the one or more desired system pressures include a plurality of the desired system pressures and are associated with all three of the following each according to different operating modes of the hydraulic system:
a standby pressure,
an operating pressure associated with an implement command of an implement of the hydraulic system, and
an unloading pressure.

4. The hydraulic system of claim 1, wherein, to control the opening of the unloading valve to operate the hydraulic system at the one or more desired system pressures, the controller is configured to:
cause the opening to move between a closed position and a partially open position.

5. The hydraulic system of claim 1, wherein the one or more desired system pressures are associated with one or more operating modes of the hydraulic system.

6. The hydraulic system of claim 1, wherein the one or more desired system pressures include a first system pressure and a second system pressure that is different than the first system pressure.

7. The hydraulic system of claim 1, wherein the actuator is an implement actuator.

8. A method for controlling a hydraulic system, the hydraulic system including a controller, a tank, a pump, an unloading valve between the tank and the pump, and at least one circuit valve between the pump and the tank, the method comprising:
receiving, by the controller, one or more inputs associated with the hydraulic system;
determining, by the controller and based on the one or more inputs, one or more desired system pressures associated with the hydraulic system; and
proportionally regulating, by the controller, an opening of the unloading valve to operate the hydraulic system at the one or more desired system pressures,
wherein unloading valve is a three-position valve and the proportional regulating of the opening of the unloading valve is according to the position of the three-position unloading valve,
wherein in a first position the unloading valve implements partial restriction for neutral bleed and/or bypass controls,
wherein in a second position the unloading valve implements full restriction to reduce or eliminate parasitic losses during full or partial implement commands, and
wherein in a third position the unloading valve implements restriction less than in the first position.

9. The method of claim 8, wherein the one or more inputs are associated with one or more operating conditions of the hydraulic system.

10. The method of claim 8, wherein proportionally regulating, by the controller, the opening of the unloading valve to operate the hydraulic system at the one or more desired system pressures comprises:
proportionally regulating the opening at least between a closed position and a partially open position.

11. The method of claim 8, wherein the one or more desired system pressures are associated with at least one of:
a standby pressure,
an operating pressure associated with an implement command of an implement of the hydraulic system, or
an unloading pressure.

12. The method of claim 8, wherein the hydraulic system is associated with a machine, and
wherein the one or more inputs are associated with at least one of:
an operator input associated with at least one of an operator interface of the machine,
a sensor device input associated with a sensor device of at least one of the hydraulic system or the machine, or
an operating condition associated with at least one of the hydraulic system or the machine.

13. The method of claim 8, wherein the one or more desired system pressures are associated with one or more operating modes of the hydraulic system.

14. The method of claim 8, wherein the actuator is an implement actuator.

15. A machine, comprising:
a hydraulic system including:
a tank to store a supply of fluid;

a pump to supply pressurized fluid;

an actuator that is displaceable from a minimum position to a maximum position;

a control valve assembly including:

an unloading valve, between the pump and the tank, the unloading valve being directly fluidly coupled to the pump and the tank and including an opening that is proportionally controllable, a first circuit valve directly fluidly coupled to the pump and the tank, and a second circuit valve directly fluidly coupled to the tank and the first circuit valve; and a controller configured to:

receive one or more inputs associated with at least one of the machine or the hydraulic system;

determine, based on the one or more inputs, one or more desired system pressures associated with at least one of the machine or the hydraulic system; and control the opening of the unloading valve to operate the hydraulic system at the one or more desired system pressures.

16. The machine of claim 15, wherein the one or more desired system pressures include a plurality of the desired system pressures and are associated with all three of the following each according to different operating modes of the hydraulic system:

a standby pressure, an operating pressure associated with an implement command of an implement of the hydraulic system, and an unloading pressure.

17. The machine of claim 15, wherein, to control the opening of the unloading valve to operate the hydraulic system at the one or more desired system pressures, the controller is configured to:

cause the opening of the unloading valve to close to prevent the pressurized fluid from flowing to the tank during displacement of the actuator between the minimum position and the maximum position.

18. The machine of claim 15, wherein the one or more inputs are associated with at least one of:

an operator input associated with at least one of an operator interface of the machine, a sensor device input associated with a sensor device of at least one of the hydraulic system or the machine, or an operating condition associated with at least one of the hydraulic system or the machine.

19. The machine of claim 15, wherein the opening of the unloading valve is movable between at least a closed position and a partially open position.

20. The machine of claim 15, further comprising:

a first hydraulic circuit to operate a first hydraulic actuator, the first hydraulic circuit being directly fluidly coupled to an output of the first circuit valve; and a second hydraulic circuit, different from the first hydraulic circuit, to operate a second hydraulic actuator different from the first hydraulic actuator, the second hydraulic circuit being directly fluidly coupled to an output of the second circuit valve.

* * * * *